US011548708B2

(12) United States Patent
Holley, Jr.

(10) Patent No.: US 11,548,708 B2
(45) Date of Patent: Jan. 10, 2023

(54) CARRIER WITH LID

(71) Applicant: Graphic Packaging International, LLC, Atlanta, GA (US)

(72) Inventor: John Murdick Holley, Jr., Lawrenceville, GA (US)

(73) Assignee: Graphic Packaging International, LLC, Atlanta, GA (US)

( * ) Notice: Subject to any disclaimer, the term of this patent is extended or adjusted under 35 U.S.C. 154(b) by 0 days.

(21) Appl. No.: 17/324,244

(22) Filed: May 19, 2021

(65) Prior Publication Data

US 2021/0362927 A1 Nov. 25, 2021

Related U.S. Application Data

(60) Provisional application No. 63/028,631, filed on May 22, 2020.

(51) Int. Cl.

| | |
|---|---|
| ***B65D 71/36*** | (2006.01) |
| ***B65D 5/64*** | (2006.01) |
| ***B65D 5/20*** | (2006.01) |

(52) U.S. Cl.

CPC ..... *B65D 71/36* (2013.01); *B65D 5/2057* (2013.01); *B65D 5/64* (2013.01); *B65D 2571/0045* (2013.01); *B65D 2571/0066* (2013.01); *B65D 2571/00456* (2013.01); *B65D 2571/00975* (2013.01)

(58) Field of Classification Search

CPC ..... B65D 71/36; B65D 5/2057; B65D 5/64; B65D 2571/0045; B65D 2571/00456; B65D 2571/0066; B65D 2571/00975; B65D 2571/00487; B65D 71/30; B65D 71/24

USPC .... 229/117.13, 117.14, 103, 120.09, 120.11, 229/120.17, 120.18; 206/188, 427, 193, 206/180

See application file for complete search history.

(56) References Cited

U.S. PATENT DOCUMENTS

| | | | |
|---|---|---|---|
| 2,222,211 | A | 11/1940 | Arneson |
| 2,225,822 | A | 12/1940 | Crook |
| 2,227,330 | A | 12/1940 | Turner |
| 2,268,209 | A | 12/1941 | Ford |
| 2,304,683 | A | 12/1942 | Finn |

(Continued)

FOREIGN PATENT DOCUMENTS

| | | |
|---|---|---|
| CN | 204236871 U | 4/2015 |
| DE | 90 04 439 | 6/1990 |

(Continued)

OTHER PUBLICATIONS

International Search Report and Written Opinion for PCT/US2021/033059 dated Sep. 7, 2021.

*Primary Examiner* — Christopher R Demeree

(74) *Attorney, Agent, or Firm* — Womble Bond Dickinson (US) LLP

(57) ABSTRACT

A carrier for holding one or more products. The carrier can comprise a plurality of panels that extends at least partially around an interior of the carrier, the plurality of panels comprising at least a front panel and a side panel. A central panel can at least partially divide the interior of the carrier into a front portion and a back portion. The side panel can extend at least partially from the front panel to the central panel. A lid can at least partially close a top of the carrier.

32 Claims, 10 Drawing Sheets

(56) References Cited

U.S. PATENT DOCUMENTS 2,331,312 A 10/1943 Dorfman
2,336,857 A 12/1943 Gies et al.
2,371,471 A 3/1945 Rothstein
2,395,711 A 2/1946 Arnold
2,457,308 A 12/1948 Hall et al.
2,460,108 A 1/1949 Smith et al.
2,563,065 A 8/1951 Price
2,565,449 A 8/1951 Emrick
2,606,711 A 8/1952 Forrer
2,637,480 A 5/1953 Forrer
2,660,361 A 11/1953 Tyrseck
2,688,421 A 9/1954 Forrer
2,689,061 A 9/1954 Gray
2,691,471 A 10/1954 Forrer
2,701,661 A 2/1955 Murray
2,721,001 A 10/1955 Hasselhoff
2,772,020 A 11/1956 Kramer
2,776,072 A 1/1957 Forrer
2,783,916 A 3/1957 Hodapp
2,785,846 A 3/1957 Weiner
2,790,590 A 4/1957 Toensmeier
2,808,177 A 10/1957 Buttery
2,812,105 A 11/1957 Parker
2,838,223 A 6/1958 Graf
2,899,104 A 8/1959 Collura
2,917,202 A 12/1959 Forrer
2,963,198 A 12/1960 Foster
2,991,908 A 7/1961 Conescu
2,993,619 A 7/1961 Arneson
3,029,977 A 4/1962 Arneson
3,053,411 A 9/1962 Struble et al.
3,128,906 A 4/1964 Forrer
3,140,036 A 7/1964 Spery
3,190,487 A 6/1965 Wood
3,191,800 A 6/1965 Kowal
3,194,478 A 7/1965 Weiss
3,229,849 A 1/1966 Spillson
3,236,414 A 2/1966 Slevin, Jr.
3,313,466 A 4/1967 Keith
3,343,742 A 9/1967 Siegler
3,352,452 A 11/1967 Graser
3,432,073 A 3/1969 Forrer
3,554,401 A 1/1971 Wood
3,624,790 A 11/1971 Stout
3,651,982 A 3/1972 Slevin
3,661,297 A 5/1972 Wood
3,669,306 A 6/1972 Forrer
3,672,539 A 6/1972 Forrer
3,709,400 A 1/1973 Arneson
3,721,335 A 3/1973 Grant
3,722,738 A 3/1973 Wright
3,739,940 A 6/1973 Harrelson
3,754,680 A 8/1973 Wood
3,757,991 A 9/1973 Stout
3,760,978 A * 9/1973 Stone ..... B65D 71/0022 206/145
3,780,906 A 12/1973 Katzenmeyer
3,784,053 A 1/1974 Stout
3,860,113 A 1/1975 Helms
3,893,565 A 7/1975 Rossi et al.
3,917,059 A 11/1975 Wood
3,917,060 A 11/1975 Wood
3,917,061 A 11/1975 Stout
4,000,813 A 1/1977 Stout
4,010,847 A 3/1977 Wood et al.
4,029,205 A 6/1977 Wood
4,153,158 A 5/1979 Graser et al.
4,171,046 A 10/1979 Bonczyk
4,187,944 A 2/1980 Wood
4,201,322 A 5/1980 Crawford
4,205,748 A 6/1980 Wilson
4,207,978 A 6/1980 Patterson
4,217,983 A 8/1980 Stout
4,243,138 A 1/1981 Wilson
4,250,992 A 2/1981 Gilbert
4,253,564 A 3/1981 Engdahl, Jr.
D261,944 S 11/1981 Stone
D262,525 S 1/1982 Killy
4,308,950 A 1/1982 Wood
4,318,470 A 3/1982 Montealegre
4,319,682 A 3/1982 Wright et al.
4,362,240 A 12/1982 Elward
4,374,561 A 2/1983 Stout et al.
4,375,846 A 3/1983 Nauheimer
4,377,252 A 3/1983 Schillinger
4,406,365 A 9/1983 Kulig
4,413,729 A 11/1983 Wood
4,450,956 A 5/1984 Wood
4,469,222 A 9/1984 Graser
4,480,746 A 11/1984 Wood
4,482,055 A 11/1984 Boyle
4,509,640 A 4/1985 Joyce
4,544,092 A 10/1985 Palmer
4,591,090 A 5/1986 Collins et al.
4,610,349 A 9/1986 Schwartz et al.
4,722,437 A 2/1988 Walsh
4,770,294 A 9/1988 Graser
4,782,943 A 11/1988 Blackman
4,782,944 A 11/1988 Engdahl, Jr.
4,792,038 A 12/1988 Cooper
4,927,009 A 5/1990 Stout
4,989,779 A * 2/1991 Lashyro ..... B65D 5/48014 206/140
5,029,698 A 7/1991 Stout
5,040,672 A 8/1991 DeMaio et al.
5,052,552 A 10/1991 Maroszek
5,072,876 A 12/1991 Wilson
5,123,588 A 6/1992 Harris
5,161,732 A 11/1992 Clein et al.
5,167,325 A 12/1992 Sykora
5,191,976 A 3/1993 Stout et al.
5,234,103 A 8/1993 Schuster
5,246,113 A 9/1993 Schuster
5,282,348 A 2/1994 Dampier et al.
5,341,984 A * 8/1994 Fogle ..... B65D 5/725 229/215
5,344,066 A * 9/1994 Fogle ..... B65D 5/705 229/231
5,359,830 A 11/1994 Olson et al.
5,363,954 A 11/1994 Dampier et al.
5,400,901 A 3/1995 Harrelson
5,439,110 A 8/1995 Regan, II
5,458,234 A 10/1995 Harris
5,482,203 A 1/1996 Stout
5,484,053 A 1/1996 Harris
5,499,712 A 3/1996 Harrelson
5,518,110 A 5/1996 Harrelson
5,531,319 A 7/1996 Harrelson
5,538,130 A 7/1996 Harrelson
5,538,131 A 7/1996 Harrelson
5,547,074 A 8/1996 Plaxico et al.
5,579,625 A 12/1996 Olson et al.
5,590,762 A 1/1997 Harrelson
5,593,027 A 1/1997 Sutherland
5,611,425 A 3/1997 Holley, Jr.
5,620,094 A 4/1997 Naumann
5,638,956 A 6/1997 Sutherland
5,645,162 A 7/1997 Harrelson
5,649,620 A 7/1997 Harrelson
5,657,864 A 8/1997 Harrelson
5,657,865 A 8/1997 Harrelson
5,680,930 A 10/1997 Stone
5,682,982 A 11/1997 Stonehouse
5,682,985 A 11/1997 Plaxico et al.
5,695,051 A 12/1997 Hart
5,709,298 A 1/1998 Harris
5,715,992 A * 2/1998 Andrews, Sr. ..... B65D 5/46104 229/104
5,765,685 A 6/1998 Roosa
5,775,487 A 7/1998 Harrelson
5,819,920 A 10/1998 Sutherland
5,848,695 A 12/1998 Harris et al.
5,855,316 A 1/1999 Spivey
5,871,090 A 2/1999 Doucette et al.

(56) References Cited

U.S. PATENT DOCUMENTS

| | | | | |
|---|---|---|---|---|
| 5,878,877 | A | 3/1999 | Sutherland | |
| 5,884,756 | A | 3/1999 | Holley, Jr. et al. | |
| 5,941,377 | A | 8/1999 | Hart et al. | |
| 5,947,273 | A | 9/1999 | Dalrymple et al. | |
| 5,979,747 | A * | 11/1999 | Gnadt | B65D 71/0014 229/117.14 |
| 6,003,665 | A | 12/1999 | Stout | |
| 6,024,212 | A | 2/2000 | Whitnell | |
| 6,041,920 | A | 3/2000 | Hart et al. | |
| 6,105,773 | A | 8/2000 | Miller | |
| 6,112,977 | A | 9/2000 | Sutherland et al. | |
| 6,131,729 | A | 10/2000 | Eckermann et al. | |
| 6,155,962 | A | 12/2000 | Dalrymple et al. | |
| 6,168,013 | B1 | 1/2001 | Gomes | |
| 6,230,881 | B1 | 5/2001 | Collura | |
| 6,230,882 | B1 | 5/2001 | Wischusen, III | |
| 6,247,585 | B1 | 6/2001 | Holley, Jr. | |
| 6,315,111 | B1 | 11/2001 | Sutherland | |
| 6,321,906 | B1 | 11/2001 | Wein | |
| 6,336,584 | B1 * | 1/2002 | Roch | B65D 5/0005 229/101.2 |
| 6,341,689 | B1 | 1/2002 | Jones | |
| 6,371,287 | B1 | 4/2002 | Jones et al. | |
| 6,571,941 | B2 | 6/2003 | Holley, Jr. | |
| D477,530 | S | 7/2003 | von Braun | |
| D484,011 | S | 12/2003 | Strobel | |
| 6,695,137 | B2 | 2/2004 | Jones et al. | |
| 6,736,260 | B2 | 5/2004 | Gomes et al. | |
| 6,802,802 | B2 | 10/2004 | Woog | |
| 6,814,228 | B2 | 11/2004 | Sutherland | |
| 6,837,420 | B2 * | 1/2005 | Westerman | B65D 5/241 229/117.15 |
| 6,938,756 | B2 | 9/2005 | Schuster | |
| 7,011,209 | B2 | 3/2006 | Sutherland et al. | |
| 7,025,197 | B2 | 4/2006 | Sutherland | |
| 7,070,045 | B2 | 7/2006 | Theelen | |
| 7,128,206 | B2 | 10/2006 | Kohler | |
| 7,134,547 | B2 | 11/2006 | Auclair | |
| 7,207,934 | B2 | 4/2007 | Schuster | |
| 7,234,596 | B2 | 6/2007 | Lebras | |
| D567,079 | S | 4/2008 | Fant | |
| D567,469 | S | 4/2008 | Koc | |
| 7,374,038 | B2 | 5/2008 | Smalley | |
| 7,448,492 | B2 | 11/2008 | Sutherland | |
| 7,472,791 | B2 | 1/2009 | Spivey, Sr. | |
| 7,552,820 | B2 | 6/2009 | Kohler | |
| 7,604,116 | B2 | 10/2009 | Schuster | |
| 7,644,817 | B2 | 1/2010 | Sutherland | |
| 7,677,387 | B2 | 3/2010 | Brand et al. | |
| D620,354 | S | 7/2010 | Block | |
| 7,762,395 | B2 | 7/2010 | Sutherland et al. | |
| 7,762,397 | B2 | 7/2010 | Coltri-Johnson et al. | |
| 7,793,780 | B2 | 9/2010 | Smalley | |
| 7,959,062 | B2 | 6/2011 | Auclair | |
| 8,020,695 | B2 | 9/2011 | Brand | |
| 8,083,126 | B2 * | 12/2011 | Fleming | B65D 71/30 229/117.14 |
| 8,087,512 | B2 | 1/2012 | Brand | |
| 8,091,702 | B1 | 1/2012 | Keip | |
| 8,297,437 | B2 | 10/2012 | Smalley et al. | |
| D684,369 | S | 6/2013 | Daigle | |
| 8,490,785 | B2 | 7/2013 | Brand | |
| D690,109 | S | 9/2013 | Shupp | |
| D694,125 | S | 11/2013 | Holsmer | |
| D695,634 | S | 12/2013 | Holsmer | |
| 8,622,207 | B2 | 1/2014 | Smalley | |
| D729,073 | S | 5/2015 | Wasilewski | |
| D744,823 | S | 12/2015 | Holley, Jr. | |
| D744,824 | S | 12/2015 | Holley, Jr. | |
| 9,415,914 | B2 | 8/2016 | Holley, Jr. | |
| D776,548 | S | 1/2017 | Bell | |
| D878,932 | S | 3/2020 | Holley, Jr. | |
| 2002/0077236 | A1 | 6/2002 | Chalendar et al. | |
| 2002/0117407 | A1 | 8/2002 | Holley | |
| 2003/0111363 | A1 | 6/2003 | Theelen | |
| 2003/0159950 | A1 | 8/2003 | Jones et al. | |
| 2003/0213705 | A1 | 11/2003 | Woog | |
| 2004/0026269 | A1 | 2/2004 | Cuomo | |
| 2004/0050722 | A1 | 3/2004 | Schuster | |
| 2004/0094435 | A1 | 5/2004 | Auclair et al. | |
| 2005/0167292 | A1 | 8/2005 | Sutherland | |
| 2005/0211577 | A1 | 9/2005 | Bakx | |
| 2005/0218014 | A1 | 10/2005 | Schuster | |
| 2005/0230273 | A1 | 10/2005 | Kohler | |
| 2006/0091024 | A1 | 5/2006 | Cuomo | |
| 2006/0148629 | A1 | 7/2006 | Cuomo | |
| 2006/0157545 | A1 | 7/2006 | Auclair | |
| 2006/0231440 | A1 | 10/2006 | Holley, Jr. | |
| 2006/0266812 | A1 | 11/2006 | Von Bokel | |
| 2007/0000980 | A1 | 1/2007 | Oliveira | |
| 2007/0017839 | A1 | 1/2007 | Sutherland | |
| 2007/0029212 | A1 | 2/2007 | Smalley | |
| 2007/0151873 | A1 | 7/2007 | Schuster | |
| 2007/0194092 | A1 | 8/2007 | Donnelly | |
| 2008/0210581 | A1 | 9/2008 | Brand | |
| 2008/0230406 | A1 | 9/2008 | Cuomo | |
| 2008/0265008 | A1 | 10/2008 | Holley | |
| 2009/0008273 | A1 | 1/2009 | Smalley | |
| 2009/0121001 | A1 | 5/2009 | Perez et al. | |
| 2009/0272663 | A1 | 11/2009 | Koch | |
| 2010/0006458 | A1 | 1/2010 | Wilkins et al. | |
| 2010/0072086 | A1 | 3/2010 | Smalley | |
| 2010/0320098 | A1 | 12/2010 | Brand | |
| 2011/0048975 | A1 | 3/2011 | Brand | |
| 2012/0000913 | A1 | 1/2012 | Smalley et al. | |
| 2014/0291386 | A1 | 10/2014 | Ikeda | |
| 2017/0144814 | A1 | 5/2017 | Schindler | |
| 2021/0362927 | A1 | 11/2021 | Holley, Jr. | |

FOREIGN PATENT DOCUMENTS

| | | |
|---|---|---|
| EP | 0 822 150 | 2/1998 |
| EP | 1 319 607 | 6/2003 |
| EP | 1 852 359 | 11/2007 |
| EP | 2 102 073 | 9/2010 |
| FR | 2 825 074 | 11/2002 |
| GB | 926874 | 5/1963 |
| GB | 199609 | 6/2022 |
| JP | 2010-265027 A | 11/2010 |
| KR | 10-2103278 B1 | 4/2020 |
| WO | WO 97/05026 | 2/1997 |
| WO | WO 99/01356 | 1/1999 |
| WO | WO 2006/020525 | 2/2006 |
| WO | WO 2008/089124 | 7/2008 |

* cited by examiner

CARRIER WITH LID

CROSS-REFERENCE TO RELATED APPLICATIONS

This application claims the benefit of U.S. Provisional Patent Application No. 63/028,631, filed on May 22, 2020.

INCORPORATION BY REFERENCE

The disclosures of U.S. Provisional Patent Application No. 63/028,631, which was filed on May 22, 2020, and U.S. Design patent application No. 29/736,956, which was filed on Jun. 4, 2020, are hereby incorporated by reference for all purposes as if presented herein in their entirety.

BACKGROUND OF THE DISCLOSURE

The present disclosure generally relates to carriers or cartons for holding and/or displaying products. More specifically, the present disclosure relates to basket-style carriers that may include tamper-resistant features.

SUMMARY OF THE DISCLOSURE

In general, one aspect of the disclosure is directed to a carrier for holding one or more products. The carrier can comprise a plurality of panels that extends at least partially around an interior of the carrier, the plurality of panels comprising at least a front panel and a side panel. A central panel can at least partially divide the interior of the carrier into a front portion and a back portion. The side panel can extend at least partially from the front panel to the central panel. A lid can at least partially close a top of the carrier.

In another aspect, the disclosure is generally directed to a blank for forming a carrier for holding one or more products. The blank can comprise a plurality of panels comprising at least a front panel and a side panel. A central panel can be for at least partially dividing the carrier formed from the blank into a front portion and a back portion. The side panel can be for extending at least partially from the front panel to the central panel when the carrier is formed from the blank. A cover feature can be for at least partially closing a top of the carrier formed from the blank.

In another aspect, the disclosure is generally directed to a method of forming a carrier for holding one or more products. The method can comprise obtaining a blank comprising a plurality of panels, a central panel, and a cover feature. The plurality of panels can comprise at least a front panel and a side panel. The method further can comprise forming an interior of the carrier by positioning the panels of the plurality of panels to extend at least partially around the interior of the carrier and positioning the central panel to at least partially divide the interior of the carrier into a front portion and a back portion. The side panel can extend at least partially between the front panel and the central panel. Also, the method can comprise folding the cover feature to at least partially close a top of the carrier.

Those skilled in the art will appreciate the above stated advantages and other advantages and benefits of various additional embodiments reading the following detailed description of the embodiments with reference to the below-listed drawing figures.

According to common practice, the various features of the drawings discussed below are not necessarily drawn to scale. Dimensions of various features and elements in the drawings may be expanded or reduced to more clearly illustrate the embodiments of the disclosure.

BRIEF DESCRIPTION OF THE DRAWINGS

Corresponding parts are designated by corresponding reference numbers throughout the drawings.

DETAILED DESCRIPTION OF THE EXEMPLARY EMBODIMENT

The present disclosure generally relates to carriers, packages, constructs, sleeves, cartons, or the like, for holding and displaying products such as produce (e.g., fruits and/or vegetables), other suitable food items, and/or other suitable articles. Carriers according to the present disclosure can accommodate products of numerous different shapes. In this specification, the terms "inner," "interior," "outer," "exterior," "lower," "bottom," "upper," "top," "front," "forward," "back," "rear," and "rearward" indicate orientations determined in relation to fully erected carriers.

Figure 1:
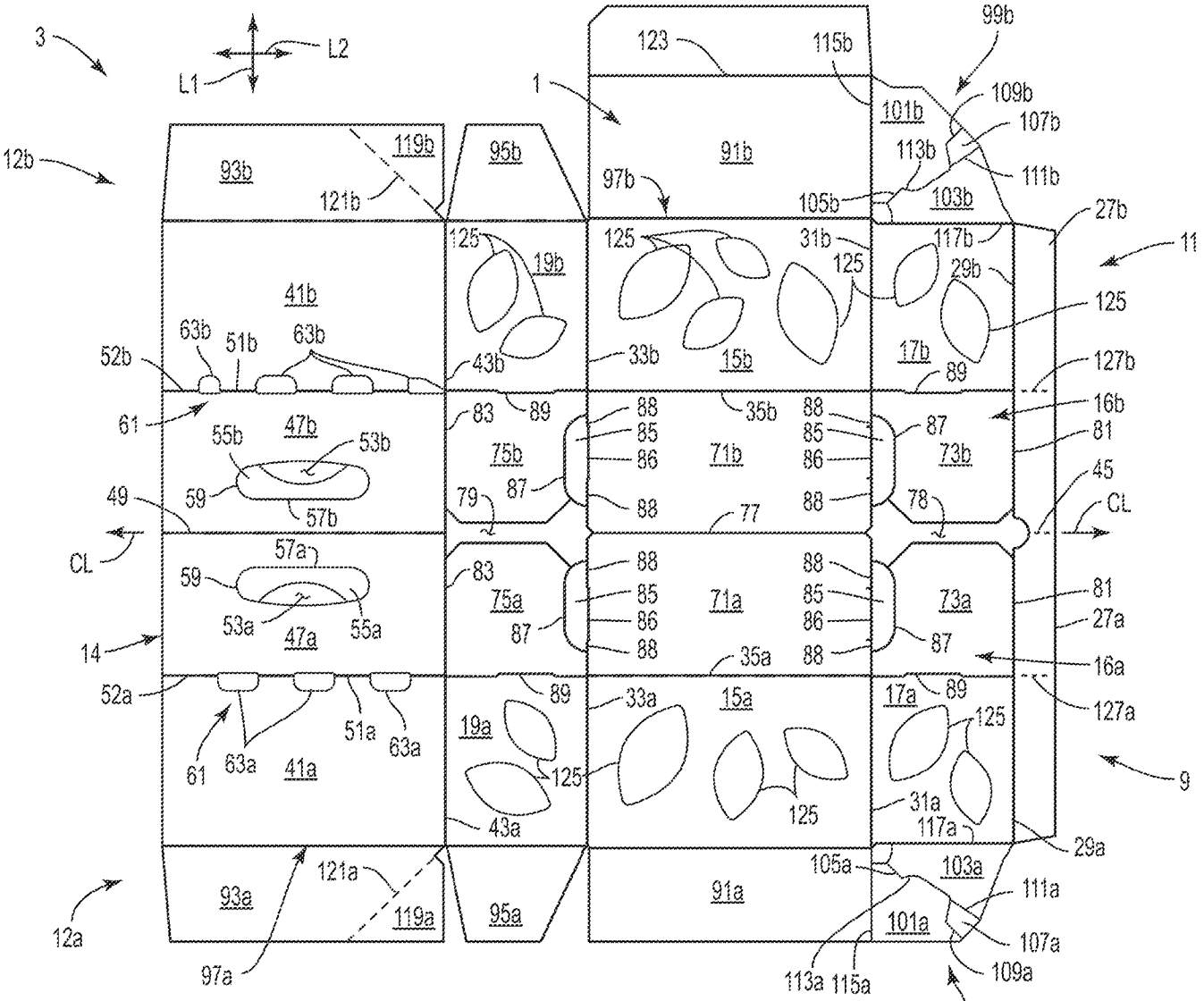
FIG. 1 is an exterior plan view of a blank used to form a carrier according to an exemplary embodiment of the disclosure.
Figure 3:
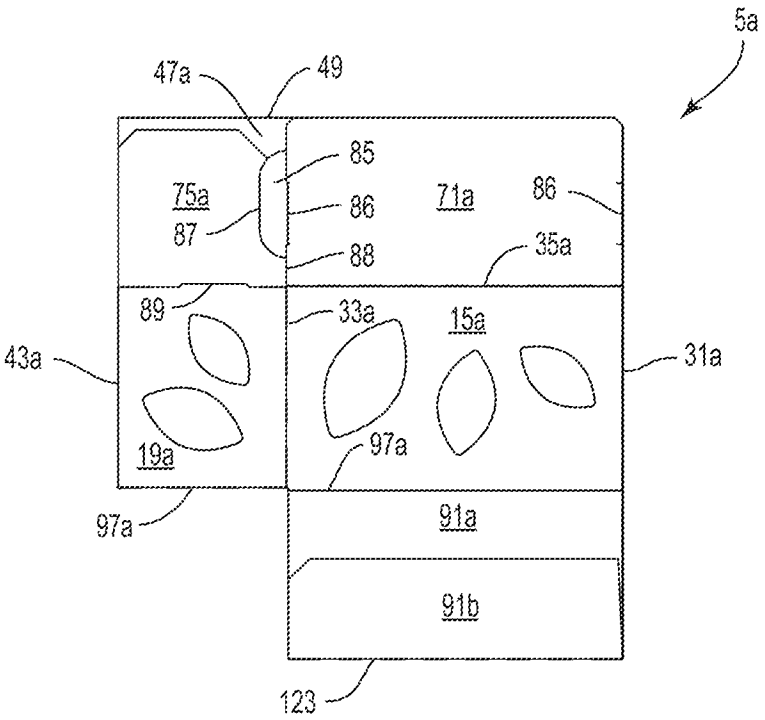
FIG. 3 is a plan view of the construct in the form of a flattened carrier according to the exemplary embodiment of the disclosure.

FIG. 1 is a plan view of an exterior side 1 of a blank 3 used to form a basket-style carrier 5 (FIG. 5) for holding products (not shown), in accordance with an exemplary embodiment of the present disclosure. In one embodiment, the carrier 5 is configured to contain one or more products in a front portion of the carrier and one or more products in a back portion of the carrier. The carrier 5 can be sized and shaped to hold more or fewer products without departing from the disclosure. In the illustrated embodiment, the carrier 5 includes a reinforced handle 7 (FIGS. 4B, 5, and 7), which can include handle features 14 (FIG. 1) as described in more detail below. In one embodiment, the blank 3 and the carrier 5 can include front cover features 16*a* for forming a lid for closing the top of the front portion of the carrier 5 and back cover features 16*b* for forming a lid for closing the top of the back portion of the carrier 5 as described in more detail below. In the illustrated embodiment, the carrier 5 is the erected carrier 5 of FIGS. 4A-7 that receives the products. As shown in FIG. 3, the carrier 5 can be in a collapsed configuration, which can be referred to as a folded or collapsed carrier 5*a* in one embodiment.

In the illustrated embodiment, the carrier blank 3 has a longitudinal axis L1 and a lateral or transverse axis L2 and has a front portion 9, a back portion 11, front bottom features 12*a* foldably connected to the front portion, and back bottom features 12*b* foldably connected to the back portion. In the illustrated embodiment, the front portion 9 and back portion 11 are for being folded about a lateral centerline CL (FIGS. 1 and 2C) when the carrier blank 3 is formed into the carrier. As discussed in more detail below, the carrier blank 3 is formed into the collapsed carrier 5*a* by folding the carrier blank 3 about the centerline CL so that the front portion 9 and the back portion 11 are generally overlapped (e.g., FIG. 3).

In the illustrated embodiment, the front portion 9, comprises a front panel 15*a* foldably connected to a first side panel 17*a* and a second side panel 19*a*. A front central flap 27*a* is foldably connected to the first side panel 17*a* at a longitudinal fold line 29*a*. Longitudinal fold lines 31*a*, 33*a* foldably connect the respective first and second side panel 17*a*, 19*a* to the front panel 15*a*. A lateral fold line 35*a* connects the front cover features 16*a* to the front panel 15*a*, the first side panel 17*a*, and the second side panel 19*a*. In one embodiment, the front portion 9 includes a front central panel 41*a* foldably connected to the second side panel 19*a* along a longitudinal fold line 43*a*.

In the illustrated embodiment, the features of the back portion 11 of the blank 3 include a back panel 15*b*, a first side panel 17*b*, a second side panel 19*b*, a back central flap 27*b* and a back central panel 41*b* that are generally a mirror-image of the corresponding panel or flap of the front portion 9. As shown in FIG. 1, the back central flap 27*b* and the front central flap 27*a* are foldably connected along a lateral fold line 45, which can be collinear (e.g., at least partially collinear, generally collinear, and/or substantially collinear) with the centerline CL. Corresponding components (e.g., panels, flaps, fold lines, cuts, etc.) have been designated by corresponding reference numbers that differ by the "a" or "b" suffix, with the "a" components corresponding to the front portion 9 and the "b" components corresponding to the back portion 11 of the blank 3.

Any of the front portion 9, the back portion 11, the front and back panels 15*a*, 15*b*, the side panels 17*a*, 19*a*, 17*b*, 19*b*, the central flaps 27*a*, 27*b*, the central panels 41*a*, 41*b*, could be omitted or could be alternatively shaped, arranged, positioned, and/or configured without departing from the present disclosure.

As shown in FIG. 1, the handle features 14 and the cover features 16*a*, 16*b* are generally disposed between the front and back portions 9, 11 in the blank 3. In the illustrated embodiment, the handle features 14 include a front handle panel 47*a* and a back handle panel 47*b* foldably connected to the front handle panel 47*a* along a lateral fold line or other line of weakening 49. In one embodiment, the lateral fold line 49 is collinear (e.g., at least partially collinear, generally collinear, and/or substantially collinear) with the centerline CL of the blank 3. The front handle panel 47*a* is foldably connected to the front central panel 41*a* along a lateral fold line 51*a*, and the back handle panel 47*b* is foldably connected to the back central panel 41*b* along a lateral fold line 51*b*. In one embodiment, the lateral fold lines 51*a*, 51*b* can be collinear (e.g., at least partially collinear, generally collinear, and/or substantially collinear) with the respective lateral fold lines 35*a*, 35*b*. The front handle panel 47*a* can include a front handle opening 53*a* and a front handle cushion flap 55*a* foldably connected to the front handle panel along a lateral fold line 57*a* adjacent the front handle opening 53*a*. The back handle panel 47*b* can include a back handle opening 53*b* and a back handle cushion flap 55*b* foldably connected to the back handle panel along a lateral fold line 57*b* adjacent the back handle opening 53*b*. The handle cushion flaps 55*a*, 55*b* can be separable from the respective central panels 41*a*, 41*b* along respective cuts 59.

As shown in FIG. 1, the blank 3 can include folding features 61 for facilitating folding of the handle panels 47*a*, 47*b* along the lateral fold lines 51*a*, 51*b* in the erected carton 5 (e.g., for stacking the carton 5 with other cartons 5) as described in more detail below. In the illustrated embodiment, the folding features 61 can include one or more folding apertures 63*a* (e.g., three folding apertures 63*a*) extending in the front central panel 41*a* and/or the front handle panel 47*a*, interrupting the lateral fold line 51*a* and one or more folding apertures 63*b* (e.g., four folding apertures 63*b*) extending in the back central panel 41*b* and/or the back handle panel 47*b*, interrupting the lateral fold line 51*b*. In one embodiment, a cut line 52*a* can extend from an end of the lateral fold line 51*a* to an edge of the blank 3 and a cut line 52*b* can extend from one of the folding apertures 63*b* or adjacent to one of the folding apertures 63*b* to the edge of the blank 3. As shown in FIG. 1, the folding apertures 63*a* and the folding apertures 63*b* are offset from one another (e.g., in the lateral direction L2) so that the folding apertures 63*a* are aligned (e.g., at least partially aligned, substantially aligned, and/or generally aligned) along the longitudinal direction L1 with respective portions or segments of the lateral fold line 51*b* extending between the folding apertures 63*b* and the folding apertures 63*b* are aligned (e.g., at least partially aligned, substantially aligned, and/or generally aligned) along the longitudinal direction L1 with respective portions or segments of the lateral fold line 51*a* extending between the folding apertures 63*a*. For example, the fold line 51*a* can have four segments aligned with the four folding apertures 63*b*, respectively, and the fold line 51*b* can have three segments aligned with the three folding apertures 63*a*, respectively. Accordingly, when the carrier 5 is formed, the folding apertures 63*a*, 63*b* are aligned with the portions of the respective fold lines 51*b*, 51*a* (FIGS. 6A and 6B) so that the portions of the lateral fold line 51*a* can extend at least partially into the respective folding apertures 63*b* or the portions of the lateral fold line 51*b* can extend at least partially into the respective folding apertures 63*a* when the handle panels 47*a*, 47*b* are folded relative to the central panels 41*a*, 41*b* in the formed carton 5 (FIG. 7) as described in more detail below.

The handle features 14 could be omitted or could be otherwise shaped, arranged, positioned, and/or configured without departing from the disclosure.

As shown in FIG. 1, the front cover features 16*a* can include a front top or cover panel 71*a* and front top or cover flaps 73*a*, 75*a* each foldably connected to the respective front panel 15*a*, first side panel 17*a*, and second side panel 19*a* along the lateral fold line 35*a*. Similarly, the back cover features 16*b* can include a back top or cover panel 71*b* and back top or cover flaps 73*b*, 75*b* each foldably connected to the respective back panel 15*b*, first side panel 17*b*, and second side panel 19*b* along the lateral fold line 35*b*. In one embodiment, the cover panels 71*a*, 71*b* can be separable from one another along a lateral cut line 77, which can be collinear (e.g., at least partially collinear, generally collinear, and/or substantially collinear) with the centerline CL, the cover flaps 73*a*, 73*b* can be spaced apart from one another by a cutout 78, and the cover flaps 75*a*, 75*b* can be spaced apart from one another by a cutout 79. As shown in FIG. 1, the cover flaps 73*a*, 73*b* can be separable from the respective central flaps 27*a*, 27*b* along respective longitudinal cut lines 81 and the cover flaps 73*a*, 73*b* can be separable from the respective handle panels 47*a*, 47*b* along respective longitudinal cuts 83.

In the illustrated embodiment, the cover features 16*a*, 16*b* can include locking tabs 85 foldably connected to the cover panels 71*a*, 71*b* along respective longitudinal fold lines 86. In one embodiment, the locking tabs 85 can be separable from the respective cover flaps 73*a*, 73*b*, 75*a*, 75*b* along respective cut lines 87 and can be at least partially separable from the cover panels 71*a*, 71*b* along longitudinal cut lines or tear lines 88 extending on either side of the respective fold lines 86 (e.g., extending from respective ends of the respective fold lines 86). In one embodiment, portions of the cover flaps 73*a*, 75*a*, 73*b*, 75*b* can be separable from portions of the respective cover panels 71*a*, 71*b* along portions of the respective longitudinal cut lines 88. As shown in FIG. 1, the cover flaps 73*a*, 73*b*, 75*a*, 75*b* can be partially separable from the respective side panels 17*a*, 17*b*, 19*a*, 19*b* along respective cuts 89 for forming respective slots 139 (FIGS. 4B and 5) that can at least partially receive the respective locking tabs 85 as described in more detail below. The cover features 16*a*, 16*b* could be omitted or could be otherwise shaped, arranged, positioned, and/or configured without departing from the disclosure.

As shown in FIG. 1, the front bottom features 12*a* can include a front bottom panel 91*a* foldably connected to the front panel 15*a*, a central bottom panel 93*a* foldably connected to the central panel 41*a*, and a bottom flap 95*a* foldably connected to the second side panel 19*a*. In the illustrated embodiment, the front bottom panel 91*a*, the central bottom panel 93*a*, and the bottom flap 95*a* are foldably connected to the respective front panel 15*a*, central panel 41*a*, and second side panel 19*a* along a lateral fold line 97*a*. As shown in FIG. 1, the front bottom panel 91*a* can be connected to the first side panel 17*a* by a gusset 99*a*, which can include a first gusset panel 101*a* foldably connected to a second gusset panel 103*a* along an oblique fold line 105*a* and an intermediate gusset panel 107*a* foldably connected to the first gusset panel 101*a* and the second gusset panel 103*a* along respective oblique fold lines 109*a*, 111*a*. In one embodiment, the first gusset panel 101*a* can be separable from the second gusset panel 103*a* and the intermediate gusset panel 107*a* along a cut line 113*a* and an opening can extend along the gusset 99*a*, the front bottom panel 91*a*, and the first side panel 17*a*. In the illustrated embodiment, the first gusset panel 101*a* can be foldably connected to the front bottom panel 91*a* along a longitudinal fold line 115*a* and the second gusset panel 103*a* can be foldably connected to the first side panel 17*a* along a lateral fold line 117*a*. As shown in FIG. 1, the central bottom panel 93*a* can include an attachment flap 119*a* at least partially defined by an oblique fold line 121*a*.

In the illustrated embodiment, the back bottom features 12*b* can include a back bottom panel 91*b*, a central bottom panel 93*b*, and a bottom flap 95*b* foldably connected to the respective back panel 15*b*, central panel 41*b*, and second side panel 19*b* along a lateral fold line 97*b*. As shown in FIG. 1, the back bottom panel 91*b* can be connected to the first side panel 17*b* by a gusset 99*b*, which can include a first gusset panel 101*b* foldably connected to a second gusset panel 103*b* along an oblique fold line 105*b* and an intermediate gusset panel 107*b* foldably connected to the first gusset panel 101*b* and the second gusset panel 103*b* along respective oblique fold lines 109*b*, 111*b*. In one embodiment, the first gusset panel 101*b* can be separable from the second gusset panel 103*b* and the intermediate gusset panel 107*b* along a cut line 113*b* and an opening can extend along the gusset 99*b*, the back bottom panel 91*b*, and the first side panel 17*b*. In the illustrated embodiment, the first gusset panel 101*b* can be foldably connected to the front bottom panel 91*b* along a longitudinal fold line 115*b* and the second gusset panel 103*b* can be foldably connected to the first side panel 17*b* along a lateral fold line 117*b*. As shown in FIG. 1, the central bottom panel 93*b* can include an attachment flap 119*b* at least partially defined by an oblique fold line 121*b*. In one embodiment, the back bottom panel 91*b* can be larger than the front bottom panel 91*a*, and the back bottom panel 91*b* can include a lateral fold line 123.

Any of the bottom features 12*a*, 12*b* could be omitted or could be otherwise shaped, arranged, positioned, and/or configured without departing from the disclosure.

As shown in FIG. 1, the blank 3 can include a plurality of openings or cutouts 125 (e.g., decorative openings or windows) in the front panel 15*a*, the back panel 15*b*, any of the side panels 17*a*, 17*b*, 19*a*, 19*b*, and/or in other portions of the blank 3 for displaying the products contained in the carton 5. Any of the cutouts 125 could be omitted or could be otherwise shaped, arranged, positioned, and/or configured without departing from the disclosure.

Any of the panels, flaps, fold lines, cuts, or other features could be omitted or could be otherwise shaped, arranged, positioned, and/or configured in the blank 3 without departing from the disclosure. The blank 3 could be sized and/or shaped to accommodate any suitable size or number of products without departing from this disclosure.

Figure 2A:
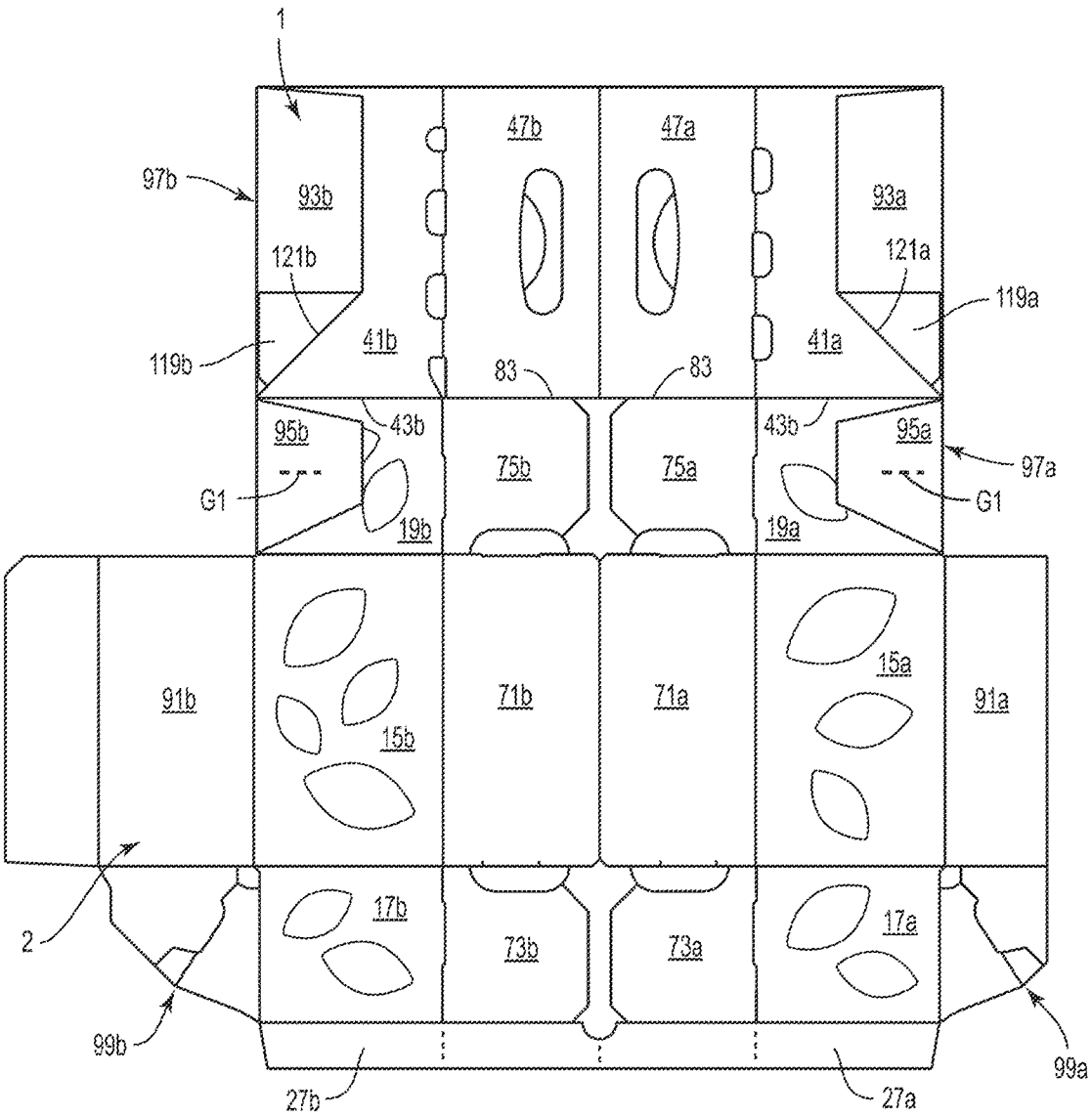
FIGS. 2A-2C are plan views showing the folding of the blank of FIG. 1 to form a folded construct according to the exemplary embodiment of the disclosure.
Figure 2B:
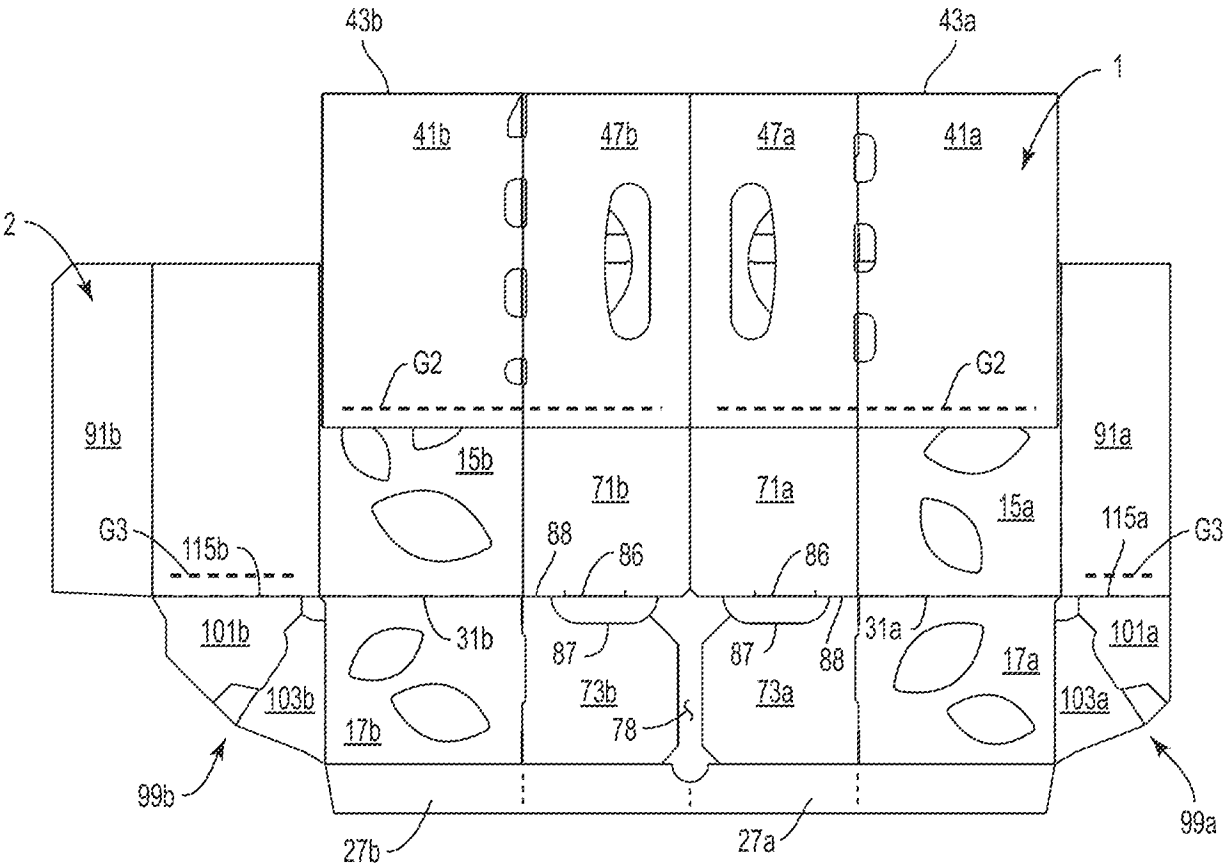
Figure 2C:
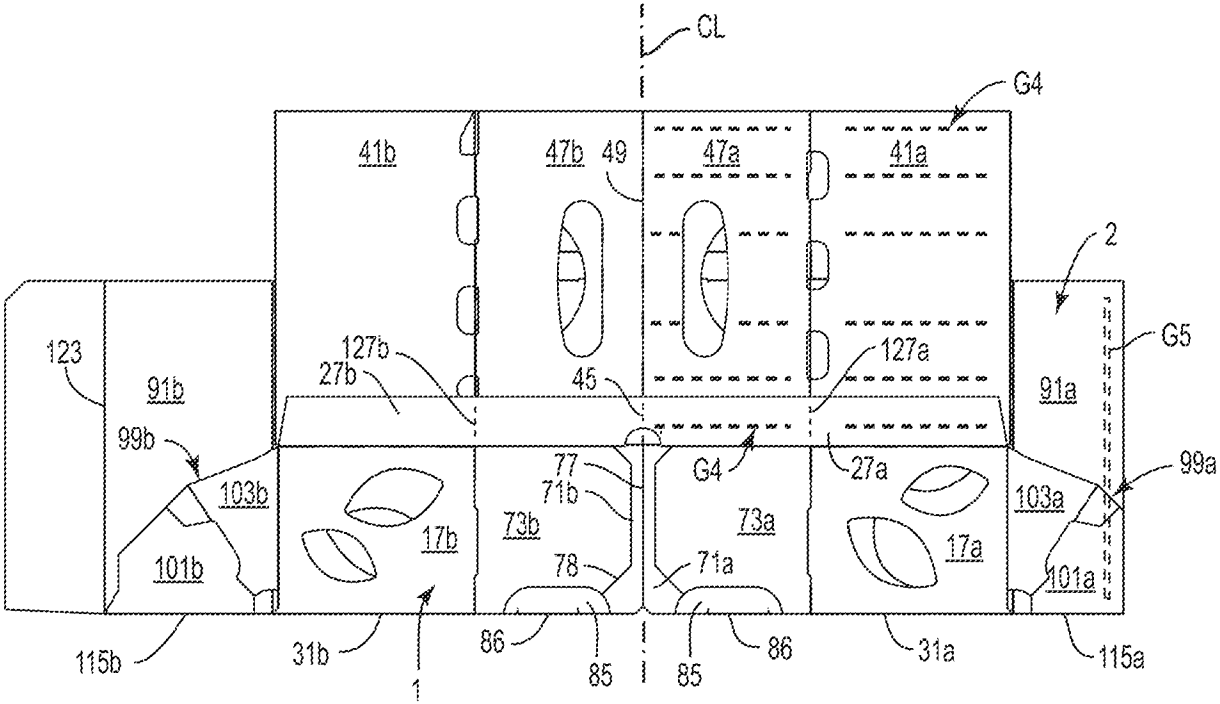

With reference to FIGS. 2A-3, in one exemplary method of erection, the collapsed carton 5*a* can be formed from the blank 3 by positioning the panels 15*a*, 15*b*, 17*a*, 17*b*, 19*a*, 19*b*, the central flaps 27*a*, 27*b*, the central panels 41*a*, 41*b*, the handle panels 47*a*, 47*b*, the bottom panels 91*a*, 91*b*, 93*a*, 93*b*, the bottom flaps 95*a*, 95*b*, and the gussets 99*a*, 99*b* relative to each other to form the front portion 9 and the back portion 11 and by folding along the centerline CL to form the collapsed carrier 5*a* (FIG. 3). As shown in FIGS. 2A-2C, the glue strips or lines G1, G2, G3, G4, G5 can be applied to different portions of the blank 3 or the partially-formed carrier during the folding of the blank to form the carrier such as by a folder/gluer system (not shown).

As shown in FIG. 2A, the blank 3 is positioned with the interior side 2 facing up, and the central bottom panels 93*a*, 93*b* are folded along the respective fold lines 97*a*, 97*b* over the respective central panels 41*a*, 41*b* and the attachment flaps 119*a*, 119*b* are folded along the respective oblique fold lines 121*a*, 121*b* over the respective central bottom panels 93*a*, 93*b*. Further, as shown in FIG. 2A, the bottom flaps 95*a*, 95*b* are folded along the respective fold lines 97*a*, 97*b* over the respective side panels 19*a*, 19*b* and glue lines G1 are applied to the exterior side 1 of the bottom flaps 95*a*, 95*b*.

As shown in FIG. 2B, the central panels 41*a*, 41*b* and the handle panels 47*a*, 47*b* are folded over a remainder of the partially folded blank with the central panels 41*a*, 41*b* being folded along the fold lines 43*a*, 43*b* so that the handle panels 47*a*, 47*b* at least partially overlap the respective cover flaps 75*a*, 75*b* and the respective cover panels 71*a*, 71*b* and so that the central panels 41*a*, 41*b* at least partially overlap the respective side panels 19*a*, 19*b* and the respective front and back panels 15*a*, 15*b*. As the central panels 41*a*, 41*b* are folded, the attachment flaps 119*a*, 119*b* are brought into face-to-face contact with the respective bottom flaps 95*a*, 95*b* so that the glue lines G1 glue the interior side 2 of the attachment flaps 119*a*, 119*b* to the exterior side 1 of the respective bottom flaps 95*a*, 95*b*. Further, as shown in FIG. 2, glue lines G2 are applied along the exterior side 1 of the central panels 41*a*, 41*b* and the handle panels 47*a*, 47*b* and glue lines G3 are applied along the interior side 2 of the bottom panels 91*a*, 91*b*.

As shown in FIG. 2C, the side panels 17*a*, 17*b*, the cover flaps 73*a*, 73*b*, and the gussets 99*a*, 99*b* are folded over the remainder of the partially folded blank with the side panels 17*a*, 17*b* being folded along the respective fold lines 31*a*, 31*b* and the gussets 99*a*, 99*b* being folded along the respective fold lines 115*a*, 115*b*. As the side panels 17*a*, 17*b* are folded, the central flaps 27*a*, 27*b* are brought into face-to-face contact with the respective central panels 41*a*, 41*b* and the respective handle panels 47*a*, 47*b* so that the glue lines G2 glue the central flaps 27*a*, 27*b* to the respective central panels 41*a*, 41*b* and the respective handle panels 47*a*, 47*b*. Additionally, as the side panels 17*a*, 17*b* are folded, the gussets 99*a*, 99*b* are brought into face-to-face contact with the respective bottom panels 91*a*, 91*b* so that the glue lines G3 glue the first gusset panels 101*a*, 101*b* to the respective bottom panels 91*a*, 91*b*. In one embodiment, the locking tabs 85 that are adjacent the cover flaps 73*a*, 73*b* can be at least partially connected to the cover flaps 73*a*, 73*b* by one or more nicks (not shown) interrupting the cut lines 87 so that the locking tabs 85 are folded along the fold lines 86 along with the cover flaps 73*a*, 73*b*. This can help keep the locking tabs 85 from protruding outwardly from the partially folded carrier and the collapsed carrier 5*a*. In other embodiments, any of the locking tabs 85 could be at least partially connected to the respective cover flaps 73*a*, 73*b*, 75*a*, 75*b* with nicks and/or any of the cut lines 87 could be tear lines. As shown in FIG. 2C, glue lines G4 can be applied to the exterior surface 1 of the front central panel 41*a*, the front handle panel 47*a*, and the front central flap 27*a* and a glue line G5 is applied to the exterior surface 1 of the front bottom panel 91*a*, wherein the exterior surface of the front bottom panel 91*a* is the hidden side in the view of FIG. 2C. Alternatively, or in addition, the glue lines G4 could be applied to the exterior surface 1 of the back central panel 41*b*, the back handle panel 47*b*, and the back central flap 27*b* and/or the glue line G5 could be applied to the interior surface 2 of the back bottom panel 91*b*.

In the exemplary embodiment, the collapsed carrier 5*a* can be formed as shown in FIG. 3, by folding the partially folded carrier of FIG. 2C along the centerline CL (e.g., along fold lines 45, 49) so that the front central flap 27*a*, the front central panel 41*a*, and the front handle panel 47*a* are in overlapping relationships with the respective back central flap 27*b*, back central panel 41*b*, and back handle panel 47*b*. In the illustrated embodiment, the front central flap 27*a*, the front central panel 41*a*, and the front handle panel 47*b* can be glued in face-to-face contact with to the respective back central flap 27*b*, back central panel 41*b*, and back handle panel 47*b*. As shown in FIG. 3, the collapsed carrier 5*a* further can be formed by folding the back bottom panel 91*b* along the fold line 123 so that the interior side 2 of the distal portion of the back bottom panel 91*b* is glued to exterior side 1 of the front bottom panel 91*a* by the glue line G5. Any of the glue lines G1, G2, G3, G4, G5 could be omitted or could be otherwise shaped, arranged, positioned, and/or configured without departing from the disclosure. Additionally, the blank 3 could be otherwise folded to form the collapsed carrier 5*a* without departing from the disclosure.

In one embodiment, the central flaps 27*a*, 27*b* are glued to the respective central panels 41*a*, 41*b* and the respective handle panels 47*a*, 47*b* by the glue lines G2 (FIGS. 2B and 2C) and, when the partially folded carrier is folded along the centerline CL (FIGS. 2C and 3), the central flaps 27*a*, 27*b* are glued together, the central panels 41*a*, 41*b* are glued together, and the handle panels 47*a*, 47*b* are glued together by glue lines G4. Accordingly, the central panels 41*a*, 41*b* and portions of the central flaps 27*a*, 27*b* cooperate to form a central wall 131, and the handle panels 47*a*, 47*b* and portions of the central flaps 27*a*, 27*b* cooperate to form the handle wall 133 extending upwardly from the central wall 131. In one embodiment, each of the central flaps 27*a*, 27*b* can be considered to have a lower portion foldably connected to an upper portion along a respective fold line 127*a*, 127*b* (FIG. 1). As shown in FIG. 2C, the fold lines 127*a*, 127*b* can be aligned with the respective fold lines 51*a*, 51*b* (and can at least partially overlap the respective cut lines 52*a*, 52*b* when the central flaps 27*a*, 27*b* are glued to the central panels 41*a*, 41*b* and the handle panels 47*a*, 47*b*. Accordingly, the lower portions of the central flaps 27*a*, 27*b* can be parts of the central wall 131 and the upper portions of the central flaps 27*a*, 27*b* can be parts of the handle wall 133 when the central wall 131 and the handle wall 133 are formed.

As described above, the bottom flaps 95*a*, 95*b* can be glued to the respective attachment flaps 119*a*, 119*b* of the central bottom panels 93*a*, 93*b* with glue lines G1 (FIGS. 2A and 2B), the first gusset panels 101*a*, 101*b* can be glued to the respective front bottom panel 91*a* and back bottom panel 91*b* with glue lines G3 (FIGS. 2B and 2C), and the back bottom panel 91*b* can be folded along the lateral fold line 123 and can be glued to the exterior surface of the front bottom panel 91*a* with the glue line G5 (FIGS. 2C and 3). Accordingly, in one embodiment, the bottom panels 91*a*, 93*a*, 91*b*, 93*b*, the bottom flaps 95*a*, 95*b*, and the gussets 99*a*, 99*b* can cooperate to at least partially form a bottom wall 135 when the carton 5 is formed and erected. In the illustrated embodiment, the bottom wall 135 is foldably connected to each of the front panel 15*a*, the back panel 15*b*, the central wall 131, and the side panels 19*a*, 19*b* along fold lines 97*a*, 97*b* and to each of the side panels 17*a*, 17*b* along fold lines 117*a*, 117*b* to help retain items in the interior 137 of the carrier 5. The central wall 131, the handle wall 133, and/or the bottom wall 135 could be omitted or could be otherwise shaped, arranged, positioned, and/or configured without departing from the disclosure.

Figure 4A:
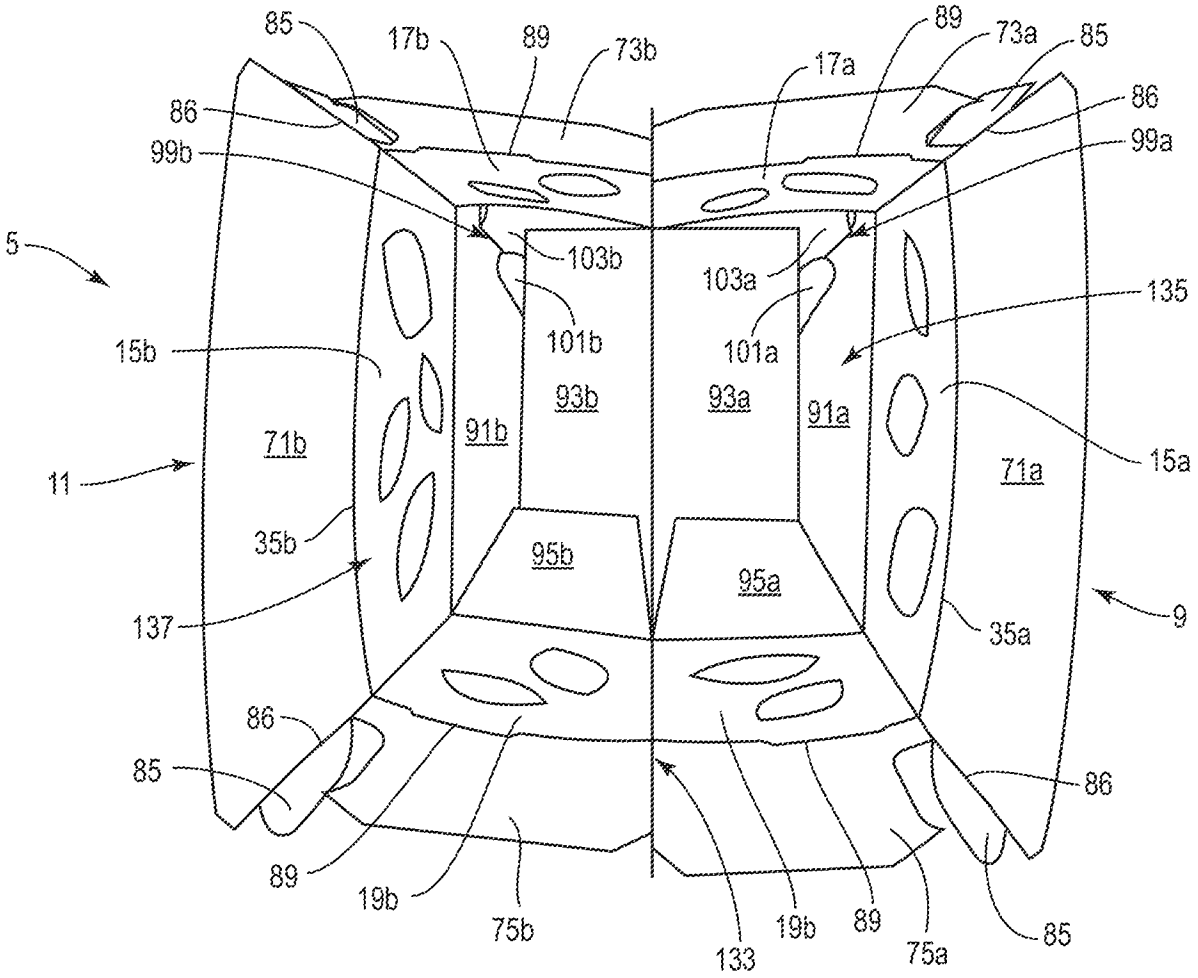
FIG. 4A is a perspective view of an interior of an erected carrier formed from the flattened carrier of FIG. 3 according to the exemplary embodiment of the disclosure.
Figure 4B:
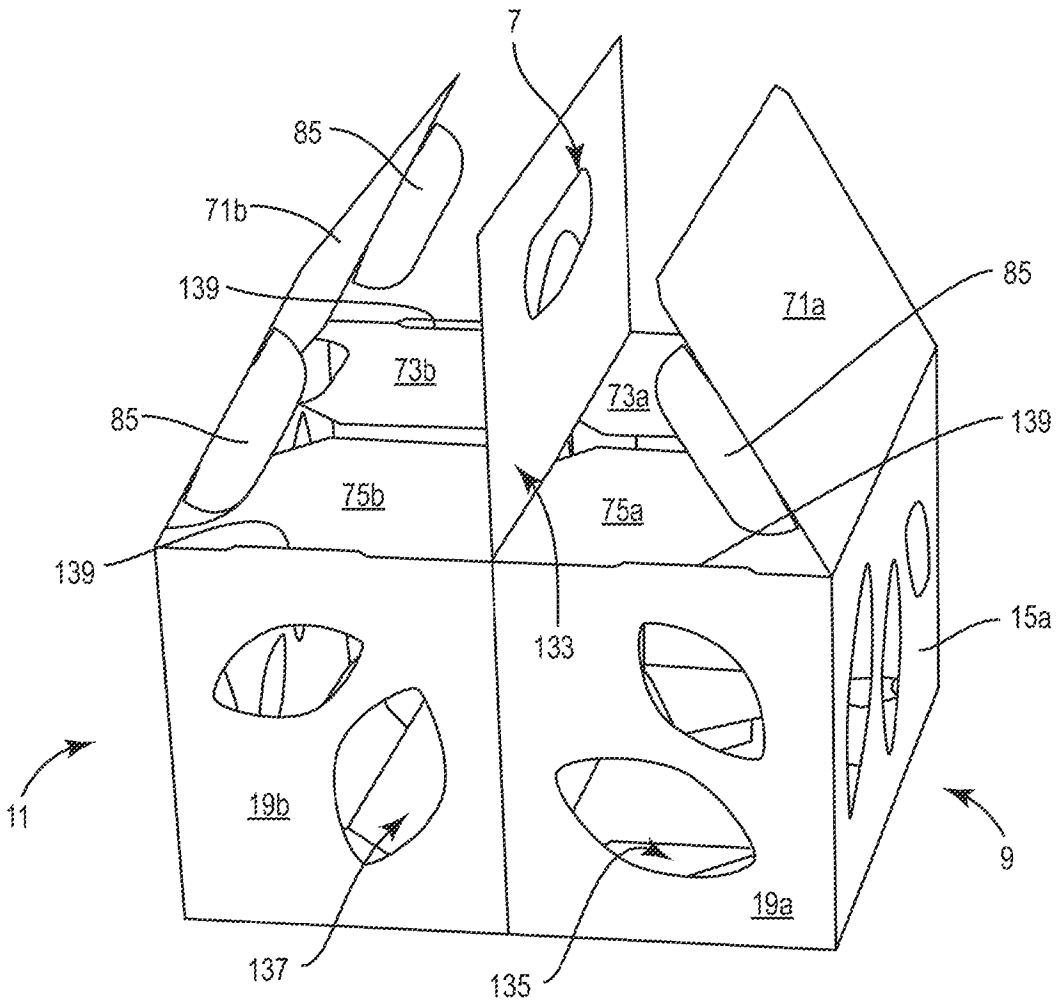
FIG. 4B is a perspective view of the carrier of FIG. 4A showing the closing of the top of the carrier according to the exemplary embodiment of the disclosure
Figure 5:
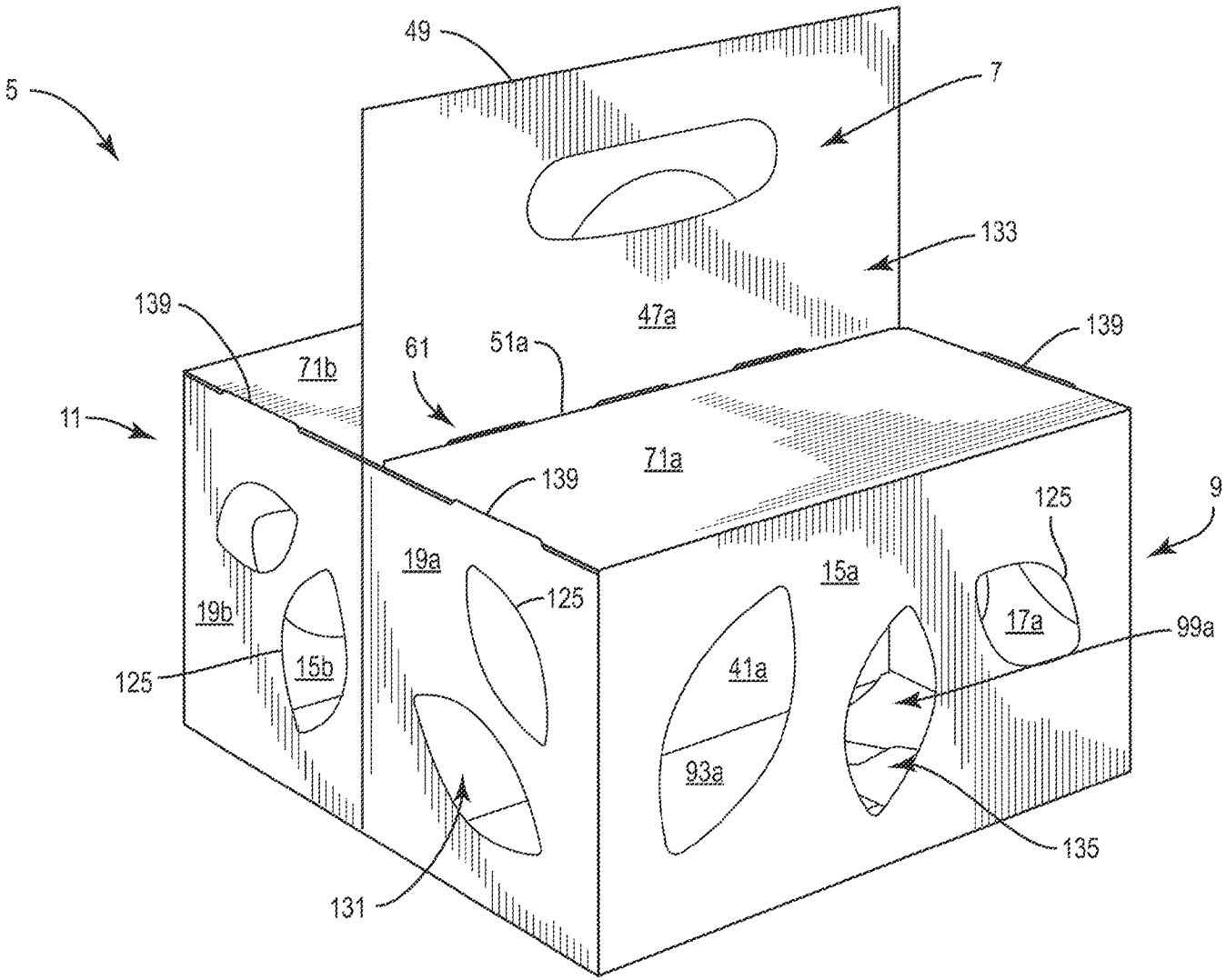
FIG. 5 is a perspective view of the erected carrier of FIGS. 4A and 4B according to the exemplary embodiment of the disclosure.

As shown in FIGS. 3-5, the folded carrier 5*a* can be further formed into the erected carrier 5 (e.g., manually and/or by a packaging system). For example, the first side panels 17*a*, 17*b* and second side panels 19*a*, 19*b* can be positioned to be in a generally spaced-apart, parallel planar relationship, and the front panel 15*a* and back panel 15*b* can be positioned to be in a generally spaced-apart, parallel planar relationship with the central wall 131 dividing the interior 137 of the carrier 5 into the front portion 9 and the back portion 11 (FIGS. 4 and 5). Such movement of the side panels 17*a*, 17*b*, 19*a*, 19*b* and front and back panels 15*a*, 15*b*, causes the back bottom panel 91*b* to fold at least partially flat across the bottom of the carrier 5 and causes the central bottom panels 93*a*, 93*b* and the bottom flaps 95*a*, 95*b* to fold down from the interior of the carrier to extend at least partially across the bottom (FIG. 4).

In the illustrated embodiment, once the carrier 5 is erected, one or more products can be loaded into the front portion 9 and/or the back portion 11 of the interior 137 and the cover features 16*a*, 16*b* can be closed (FIG. 5). In one embodiment, the front portion 9 can be closed by folding the front cover flaps 73*a*, 75*a* along the lateral fold line 35*a* over the open top of the front portion 9 (FIG. 4B). In the illustrated embodiment, the cuts 89 can form slots 139 (FIG. 4B) between the side panels 17*a*, 19*a* and the respective front cover flaps 73*a*, 75*a* for receiving the locking tabs 85.

As shown in FIG. 4B, the locking tabs 85 can be folded along the respective longitudinal fold lines 86 toward the handle wall 133 and the front cover panel 71*a* can be folded along the lateral fold line 35*a* over the front cover flaps 73*a*, 75*a* and the partially open top of the front portion 9. As the front cover panel 71*a* is folded down, the locking tabs 85 can be inserted into the respective slots 139 formed by the cuts 89 and the ends of the locking tabs 89 (e.g., where the locking tabs 89 separate from the cover panel 71*a* along the cuts 88) can at least partially engage the front cover flaps 73*a*, 75*a* adjacent the slots in the interior of the carrier to help retain the front cover panel 71*a* in the closed position. In one embodiment, the back cover flaps 73*b*, 75*b* and the back cover panel 71*b* can be closed in a similar or identical manner as the front cover panel and flaps. As shown in FIGS. 4B and 5, the front cover panel 71*a* can overlap the front cover flaps 73*a*, 75*a* and can extend from the front panel 15*a* to the central wall 131 so that the front cover panel 71*a* and the front cover flaps 73*a*, 75*a* at least partially cover the front portion of the carrier 5. Further as shown in FIGS. 4B and 5, the back cover panel 71*b* can overlap the back cover flaps 73*b*, 75*b* and can extend from the back panel 15*b* to the central wall 131 so that the back cover panel 71*b* and the back cover flaps 73*b*, 75*b* can at least partially cover the back portion of the carrier 5.

In one embodiment, the closure of the top panels 71*a*, 71*b* and the cover flaps 73*a*, 75*a*, 73*b*, 75*b* and the locking engagement of the locking tabs 89 can facilitate the tamper resistance feature of the carrier 5. For example, the time required to open the top of the carrier 5 to access the contents makes it less likely that products in the carrier will be accessed unnoticed and less likely that the products will be removed and/or engaged with prior to purchase. Also, in some embodiments, the locking tabs 89 and/or other features of the carrier 5 can be torn and/or creased when opening the top of the carrier so that an observer can see that the carrier has been opened. For example, the edges of the locking tabs 89 formed along the cuts 88 (e.g., extending from the ends of the fold lines 86) can abut the undersides of the front cover flaps 73*a*, 75*a* to resist removal of the locking tabs 89 from the slot 139, which can lead to tearing and/or creasing of the locking tabs 89 and/or adjacent the slots 139 when the locking tabs 89 are forcibly removed from the slots 139. Accordingly, the carrier 5 can help protect the personal health security of a consumer/costumer (e.g., the consumer can be assured that there has been limited contact with the products in the carrier or can observe the evidence that the package has been previously opened).

Figure 6A:
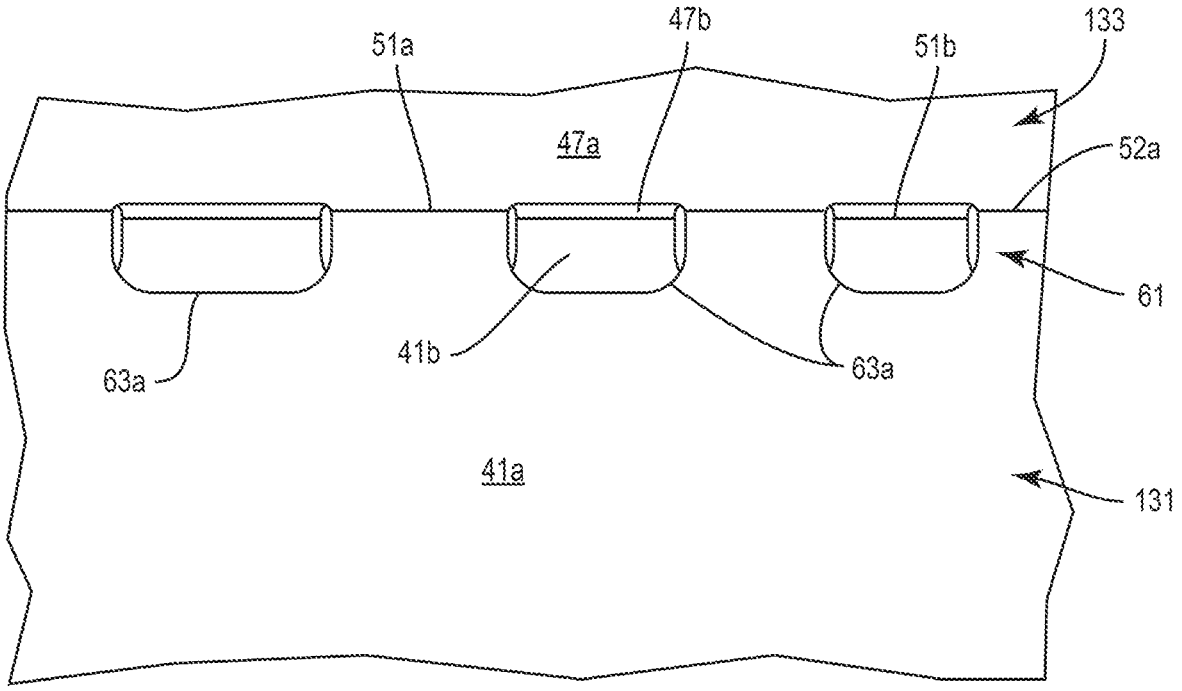
FIGS. 6A and 6B are views of folding features in the interior of the carrier of FIG. 5 according to the exemplary embodiment of the disclosure.
Figure 6B:
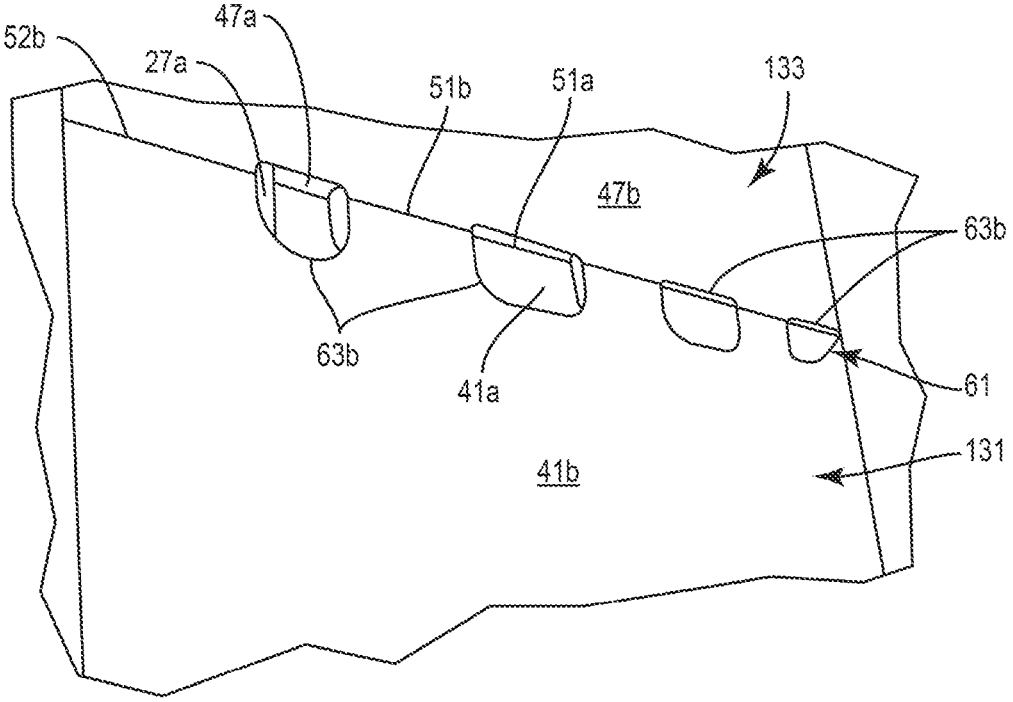
Figure 7:
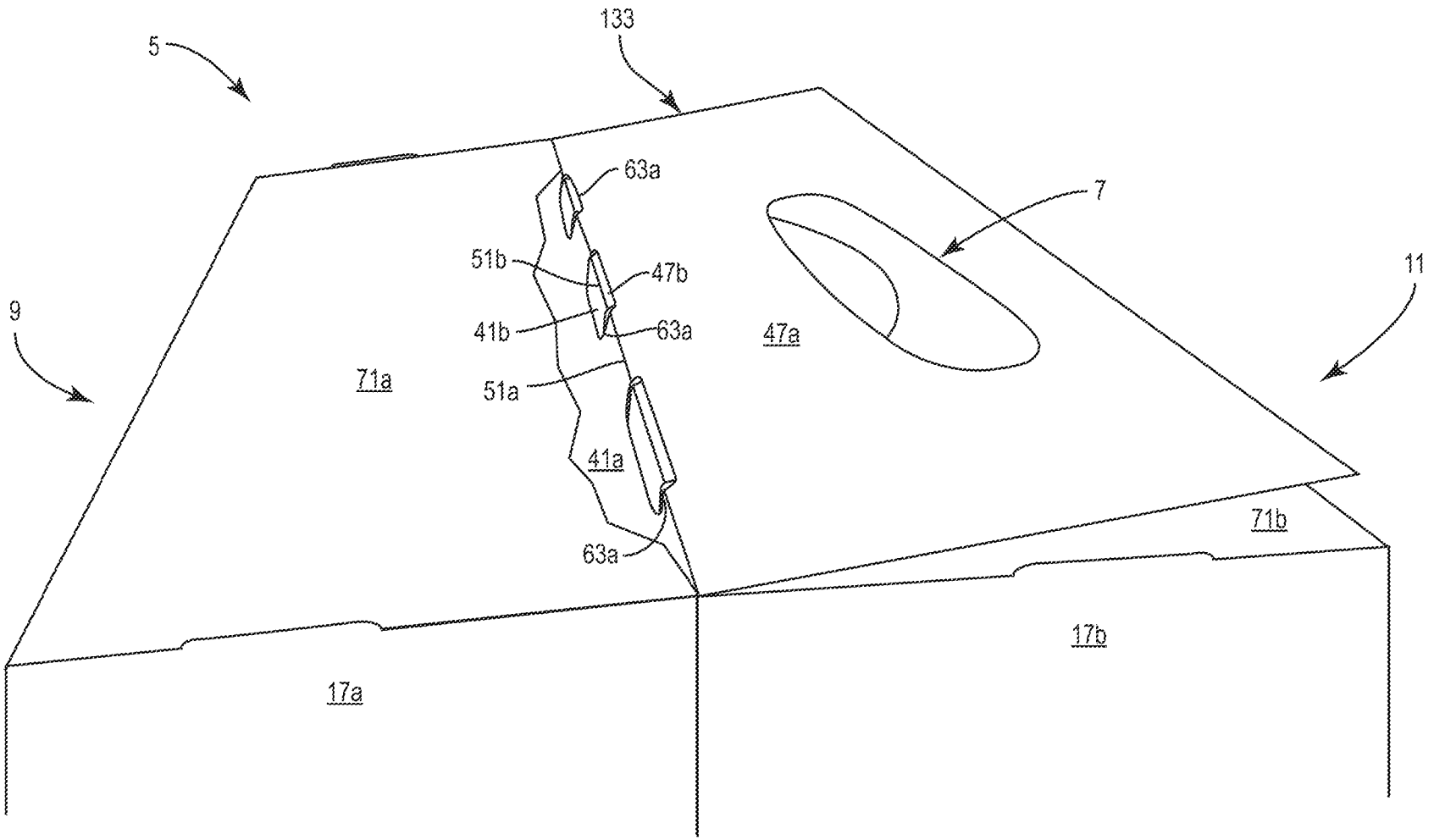
FIG. 7 is a perspective view of the carrier of FIG. 5 with the handle panel folded and a portion of the carrier broken away to show the folding features of FIG. 6A according to the exemplary embodiment of the disclosure.

In the illustrated embodiment, the closed carrier 5 can be stacked with other closed carriers 5 by folding the handle wall 133 from a vertical configuration (FIG. 5) either over the closed top of the front portion 9 or the back portion 11 of the carrier 5 to a folded configuration (e.g., FIG. 7). In an exemplary embodiment, the folding features 61 can facilitate folding of the handle wall 133 relative to the central wall 131. As shown in FIGS. 6A and 6B, segments of the fold line 51*b* connecting the handle panel 47*b* to the central panel 41*b* are aligned with the respective folding apertures 63*a* in the central panel 41*a* and the handle panel 47*a*, and segments of the fold line 51*a* connecting the handle panel 47*a* to the central panel 41*a* are aligned with the respective folding apertures 63*b* in the central panel 41*b* and the handle panel 47*b* when the central wall 131 and the handle wall 133 are formed by overlapping the central panel 41*a* and the handle panel 47*a* with the respective central panel 41*b* and the handle 47*b*. In one embodiment, as shown in FIG. 7, the handle wall 133 can be folded over the back portion 11 of the carrier 5 (e.g., to at least partially overlap the back cover panel 71*b*) by folding the handle panels 47*a*, 47*b* along the lateral fold lines 51*a*, 51*b*. The segments of the lateral fold line 51*b* and portions of the back central panel 41*b* and the back handle panel 47*b* connected along the segments on the inside of the fold can extend at least partially into respective front folding apertures 63*a* in the front central panel 41*a* and the front handle panel 47*a* on the outside of the fold to facilitate the folding of the overlapped and glued handle panels 47*a*, 47*b* (e.g., the handle wall 133). In one embodiment, the segments of the lateral fold line 51*a* and portions of the front central panel 41*a* and the front handle panel 47*a* connected along the segments on the outside of the fold can be at least partially received in the back folding apertures 63*b* on the inside of the fold as the segments of the fold line 51*b* extend through the front folding apertures 63*a* (FIG. 7). With the handle wall 133 folded against the back cover panel 71*b* (e.g., as shown in FIG. 7), another carrier can be stacked on top of the carrier 5 in an exemplary embodiment. The handle wall 133 could be folded over the front portion 9 of the carrier 5 in a similar manner.

Any of the features of the various embodiments of the disclosure can be combined with, replaced by, or otherwise configured with other features of other embodiments of the disclosure without departing from the scope of this disclosure.

In general, the blank may be constructed from paperboard having a caliper so that it is heavier and more rigid than ordinary paper. The blank can also be constructed of other materials, such as cardboard, or any other material having properties suitable for enabling the carrier or carton to function at least generally as described above. The blank can be coated with, for example, a clay coating. The clay coating may then be printed over with product, advertising, and other information or images. The blanks may then be coated with a varnish to protect information printed on the blanks. The blanks may also be coated with, for example, a moisture barrier layer, on either or both sides of the blanks. The blanks can also be laminated to or coated with one or more sheet-like materials at selected panels or panel sections.

As an example, a tear line can include: a slit that extends partially into the material along the desired line of weakness, and/or a series of spaced apart slits that extend partially into and/or completely through the material along the desired line of weakness, or various combinations of these features. As a more specific example, one type tear line is in the form of a series of spaced apart slits that extend completely through the material, with adjacent slits being spaced apart slightly so that a nick (e.g., a small somewhat bridging-like piece of the material) is defined between the adjacent slits for typically temporarily connecting the material across the tear line. The nicks are broken during tearing along the tear line. The nicks typically are a relatively small percentage of the tear line, and alternatively the nicks can be omitted from or torn in a tear line such that the tear line is a continuous cut line. That is, it is within the scope of the present disclosure for each of the tear lines to be replaced with a continuous slit, or the like. For example, a cut line can be a continuous slit or could be wider than a slit without departing from the present disclosure.

In accordance with the exemplary embodiments, a fold line can be any substantially linear, although not necessarily straight, form of weakening that facilitates folding thereal-ong. More specifically, but not for the purpose of narrowing the scope of the present disclosure, fold lines include: a score line, such as lines formed with a blunt scoring knife, or the like, which creates a crushed or depressed portion in the material along the desired line of weakness; a cut that extends partially into a material along the desired line of weakness, and/or a series of cuts that extend partially into and/or completely through the material along the desired line of weakness; and various combinations of these features. In situations where cutting is used to create a fold line, typically the cutting will not be overly extensive in a manner that might cause a reasonable user to incorrectly consider the fold line to be a tear line.

The above embodiments may be described as having one or more panels adhered together by glue during erection of the carrier embodiments. The term "glue" is intended to encompass all manner of adhesives commonly used to secure carrier panels in place.

The foregoing description of the disclosure illustrates and describes various exemplary embodiments. Various additions, modifications, changes, etc., could be made to the exemplary embodiments without departing from the spirit and scope of the disclosure. It is intended that all matter contained in the above description or shown in the accompanying drawings shall be interpreted as illustrative and not in a limiting sense. Additionally, the disclosure shows and describes only selected embodiments of the disclosure, but the disclosure is capable of use in various other combinations, modifications, and environments and is capable of changes or modifications within the scope of the inventive concept as expressed herein, commensurate with the above teachings, and/or within the skill or knowledge of the relevant art. Furthermore, certain features and characteristics of each embodiment may be selectively interchanged and applied to other illustrated and non-illustrated embodiments of the disclosure.

What is claimed is:

1. A carrier for holding one or more products, the carrier comprising:

a plurality of panels that extends at least partially around an interior of the carrier, the plurality of panels comprising at least a front panel and a side panel;

a central wall comprising a central panel and at least partially dividing the interior of the carrier into a front portion and a back portion, the side panel extending at least partially from the front panel to the central panel;

a lid at least partially closing a top of the carrier, wherein the lid comprises a cover panel foldably connected to the front panel and extending at least partially from the front panel to the central panel to at least partially cover the front portion of the carrier;

a handle wall foldably connected to the central wall; and folding features that facilitate folding the handle wall from an upright configuration over the cover panel to a folded configuration.

2. The carrier of claim 1, wherein the lid further comprises a cover flap foldably connected to the side panel, and the cover panel at least partially overlaps the cover flap.

3. The carrier of claim 1, wherein the side panel is a first side panel, the plurality of panels comprises a second side panel extending at least partially from the front panel to the central panel, the lid further comprises a first cover flap foldably connected to the first side panel a second cover flap foldably connected to the second side panel, and the cover panel at least partially overlaps the first cover flap and the second cover flap.

4. The carrier of claim 1, further comprising a handle extending in the handle wall, wherein the handle wall extends upwardly from the central wall when the handle wall is in the upright configuration.

5. The carrier of claim 1, wherein the plurality of panels further comprises a back panel, the cover panel is a front cover panel, and the lid further comprises a back cover panel foldably connected to the back panel and extending at least partially from the back panel to the central panel to at least partially cover the back portion of the carrier.

6. The carrier of claim 1, wherein the central panel is a front central panel, the central wall further comprises a back central panel in an overlapping relationship with the front central panel, the handle wall comprises a front handle panel in an overlapping relationship with a back handle panel, the front handle panel is foldably connected to the front central panel along a first fold line, and the back handle panel is foldably connected to the back central panel along a second fold line.

7. The carrier of claim 6, wherein the folding features comprise a plurality of folding apertures extending in at least one of the front central panel and the front handle panel, each folding aperture of the plurality of folding apertures is aligned with a respective segment of the second fold line so that the segments can be at least partially received through the respective folding apertures when the handle wall is in the folded configuration.

8. The carrier of claim 7, wherein the plurality of panels further comprises a back panel, the lid comprises a cover panel foldably connected to the back panel, the cover panel at least partially covers the back portion of the carrier, and the handle wall at least partially overlaps the cover panel when the handle wall is in the folded configuration.

9. The carrier of claim 6, wherein the folding features comprise a plurality of front folding apertures extending in at least one of the front central panel and the front handle panel and a plurality of back folding apertures extending in at least one of the back central panel and the back handle panel, each front folding aperture of the plurality of front folding apertures is aligned with a respective segment of the second fold line so that the segments can be at least partially received through the respective front folding apertures when the handle wall is in the folded configuration, and each back folding aperture of the plurality of back front folding apertures is aligned with a respective segment of the first fold line so that the segments can be at least partially received through the respective back folding apertures when the handle wall is in the folded configuration.

10. The carrier of claim 1, wherein the handle wall is folded over one of the back portion and the front portion of the carrier in the folded configuration.

11. The carrier of claim 1, further comprising a handle opening extending in the handle wall.

12. The carrier of claim 1, wherein a handle extends in the handle wall, and a portion of the handle wall extending above the handle when the handle wall is in the upright configuration contacts the lid when the handle wall is in the folded configuration.

13. A carrier for holding one or more products, the carrier comprising:

a plurality of panels that extends at least partially around an interior of the carrier, the plurality of panels comprising at least a front panel and a side panel;

a central wall comprising a central panel and at least partially dividing the interior of the carrier into a front portion and a back portion, the side panel extending at least partially from the front panel to the central panel;

a lid at least partially closing a top of the carrier, wherein the lid comprises a cover panel foldably connected to the front panel and extending at least partially from the front panel to the central panel to at least partially cover the front portion of the carrier, the lid further comprises a cover flap foldably connected to the side panel, a locking tab foldably connected to the cover panel, and a slot extending between the cover flap and the side panel, and the cover panel at least partially overlaps the cover flap and the locking flap is at least partially inserted into the slot;

a handle wall foldably connected to the central wall; and folding features that facilitate folding the handle wall from an upright configuration to a folded configuration.

14. The carrier of claim 13, wherein the locking tab is foldably connected to the cover panel along a fold line, the locking tab has an edge extending from an end of the fold line, and the edge at least partially engages the cover flap adjacent the slot to resist removal of the locking tab from the slot.

15. A blank for forming a carrier for holding one or more products, the blank comprising:

a plurality of panels comprising at least a front panel and a side panel;

a central panel for at least partially forming a central wall in the carrier formed from the blank for at least partially dividing the carrier formed from the blank into a front portion and a back portion, the side panel being for extending at least partially from the front panel to the central panel when the carrier is formed from the blank;

a cover feature for at least partially closing a top of the carrier formed from the blank, wherein the cover feature comprises a cover panel foldably connected to the front panel, the cover panel being for extending at least partially from the front panel to the central panel to at least partially cover the front portion of the carrier formed from the blank;

a handle panel foldably connected to the central panel, the handle panel being for at least partially forming a handle wall when the carrier is formed from the blank; and folding features in at least one of the handle panel and the central panel for facilitating folding the handle wall from an upright configuration over the cover panel to a folded configuration when the carrier is formed from the blank.

16. The blank of claim 15, wherein the cover feature further comprises a cover flap foldably connected to the side panel, the cover panel being for at least partially overlapping the cover flap when the carrier is formed from the blank.

17. The blank of claim 15, wherein the side panel is a first side panel, the plurality of panels comprises a second side panel for extending at least partially from the front panel to the central panel when the carrier is formed from the blank, the cover feature further comprises a first cover flap foldably connected to the first side panel and a second cover flap foldably connected to the second side panel, and the first cover flap and the second cover flap are separable from the cover panel along respective cut lines.

18. The blank of claim 15, wherein the plurality of panels further comprises a back panel, the cover panel is a front cover panel, the cover feature further comprises a back cover panel foldably connected to the back panel, and the front cover panel is separable from the back cover panel along a cut line.

19. The blank of claim 15, wherein the side panel is a front side panel, the plurality of panels further comprises a back panel and a back side panel, the cover panel is a front cover panel, the cover feature further comprises a back cover panel foldably connected to the back panel, a front cover flap foldably connected to the front side panel, and a back cover flap foldably connected to the back side panel, the front cover panel and the back cover panel extend between at least the front panel and the back panel in the blank, and the front cover flap and the back cover flap extend between at least the front side panel and the back side panel in the blank.

20. The blank of claim 15, wherein the central panel is a front central panel, the handle panel is a front handle panel, the front central panel is foldably connected to the front handle panel along a first fold line, the blank further comprises a back central panel foldably connected to a back handle panel along a second fold line, and the front central panel and the front handle panel are for being in an overlapping relationship with the respective back central panel and back handle panel to form the respective central wall and handle wall when the carrier is formed from the blank.

21. The blank of claim 20, wherein the folding features comprise a plurality of folding apertures extending in at least one of the front central panel and the front handle panel, each folding aperture of the plurality of folding apertures is aligned with a respective segment of the second fold line along a longitudinal direction of the blank.

22. The blank of claim 20, wherein the folding features comprise a plurality of front folding apertures extending in at least one of the front central panel and the front handle panel and a plurality of back folding apertures extending in at least one of the back central panel and the back handle panel, each front folding aperture of the plurality of front folding apertures is aligned with a respective segment of the second fold line along a longitudinal direction of the blank, and each back folding aperture of the plurality of back front folding apertures is aligned with a respective segment of the first fold line along the longitudinal direction of the blank.

23. The blank of claim 22, wherein each of the back folding apertures is offset from the front folding apertures along a lateral direction of the blank, and the first fold line and the second fold line extend in the lateral direction.

24. The blank of claim 15, further comprising a handle opening extending in the handle panel.

25. A blank for forming a carrier for holding one or more products, the blank comprising:

a plurality of panels comprising at least a front panel and a side panel;

a central panel for at least partially forming a central wall in the carrier formed from the blank for at least partially dividing the carrier formed from the blank into a front portion and a back portion, the side panel being for extending at least partially from the front panel to the central panel when the carrier is formed from the blank;

a cover feature for at least partially closing a top of the carrier formed from the blank, wherein the cover feature comprises a cover panel foldably connected to the front panel, the cover panel being for extending at least partially from the front panel to the central panel to at least partially cover the front portion of the carrier formed from the blank, the cover feature further comprises a cover flap foldably connected to the side panel and a locking tab foldably connected to the cover panel, the cover flap is at least partially separable from the side panel along a cut, and the cut is for forming a slot for at least partially receiving the locking tab when the carrier is formed from the blank, the cover panel being for at least partially overlapping the cover flap when the carrier is formed from the blank;

a handle panel foldably connected to the central panel, the handle panel being for at least partially forming a handle wall when the carrier is formed from the blank; and folding features in at least one of the handle panel and the central panel for facilitating folding the handle wall from an upright configuration to a folded configuration when the carrier is formed from the blank.

26. The blank of claim 25, wherein the locking tab is separable from the cover flap along a cut line.

27. A method of forming a carrier for holding one or more products, the method comprising:

obtaining a blank comprising a plurality of panels, a central panel, a handle panel foldably connected to the central panel, folding features in at least one of the handle panel and the central panel, and a cover feature, the plurality of panels comprising at least a front panel and a side panel and the cover feature comprising a cover panel foldably connected to the front panel;

forming an interior of the carrier by positioning the panels of the plurality of panels to extend at least partially around the interior of the carrier, forming a handle wall comprising at least the handle panel, and forming a central wall comprising at least the central panel, the central wall at least partially dividing the interior of the carrier into a front portion and a back portion, the side panel extending at least partially between the front panel and the central panel; and folding the cover feature to at least partially close a top of the carrier, wherein the folding the cover feature comprises folding the cover panel to extend at least partially from the front panel to the central panel to at least partially cover the front portion of the carrier;

wherein the folding features facilitate folding the handle wall from an upright configuration over the cover panel to a folded configuration.

28. The method of claim 27, wherein the cover feature further comprises a cover flap foldably connected to the side panel, the folding the cover feature further comprises folding the cover flap over the front portion of the carrier, and the folding the cover panel comprises positioning the cover panel to at least partially overlap the cover flap.

29. The method of claim 28, wherein the cover feature further comprises a locking tab foldably connected to the cover panel, the cover flap is at least partially separable from the side panel along a cut, and the folding the cover flap forms the cut into a slot, and the method further comprises at least partially inserting the locking tab into the slot during the folding the cover panel.

30. The method of claim 27, wherein the central panel is a front central panel, the handle panel is a front handle panel, the front handle panel is foldably connected to the front central panel along a first fold line, the blank further comprises a back central panel and a back handle panel foldably connected to the back central panel along a second fold line, the forming the central wall comprises positioning the front central panel and the back central panel into an overlapping relationship, and the forming the handle wall comprises positioning the front handle panel and the back handle panel into an overlapping relationship.

31. The method of claim 30, wherein the folding features comprise a plurality of folding apertures extending in at least one of the front central panel and the front handle panel, each folding aperture of the plurality of folding apertures is aligned with a respective segment of the second fold line so that the segments can be at least partially received through the respective folding apertures when the handle wall is in the folded configuration.

32. A carrier for holding one or more products, the carrier comprising:

a plurality of panels that extends at least partially around an interior of the carrier, the plurality of panels comprising at least a front panel, a back panel, and a side panel;

a central wall comprising a central panel and at least partially dividing the interior of the carrier into a front portion and a back portion, the side panel extending at least partially from the front panel to the central panel;

a lid at least partially closing a top of the carrier, wherein the lid comprises a front cover panel foldably connected to the front panel and extending at least partially from the front panel to the central panel to at least partially cover the front portion of the carrier, and the lid further comprises a back cover panel foldably connected to the back panel and extending at least partially from the back panel to the central panel to at least partially cover the back portion of the carrier;

a handle wall foldably connected to the central wall; and folding features that facilitate folding the handle wall from an upright configuration to a folded configuration, wherein the folding features facilitate folding the handle wall from the upright configuration over the front cover panel and facilitate folding the handle wall from the upright configuration over the back cover panel.

* * * * *